United States Patent [19]

Heufler et al.

[11] Patent Number: 4,828,175

[45] Date of Patent: May 9, 1989

[54] SNOW-MAKING MACHINE

[75] Inventors: Siegfried Heufler, Hard; Hans Sesser, Bregenz, both of Austria

[73] Assignee: SUFAG Sport- Und Freizeitanlagen Gesellschaft m.b.H., Kennelbach, Austria

[21] Appl. No.: 151,858

[22] Filed: Feb. 3, 1988

[30] Foreign Application Priority Data

Feb. 3, 1987 [AT] Austria ..... 216/87

[51] Int. Cl.[4] ..... F25C 03/04

[52] U.S. Cl. ..... 239/14.2; 239/135; 239/397.5; 181/202; 181/286; 181/293; 415/119

[58] Field of Search ..... 239/2.2, 14.2, 135, 239/397.5; 415/119, 121 A, 175, 176; 181/213, 214, 222, 286, 293, 288, 291, 202, 290

[56] References Cited

U.S. PATENT DOCUMENTS

| | | | |
|---|---|---|---|
| 3,692,140 | 9/1972 | Smith | 181/213 |
| 4,056,161 | 11/1977 | Allen, Jr. | 181/290 |
| 4,083,492 | 4/1978 | Dewey | 239/14.2 |
| 4,441,578 | 4/1984 | Rose | 181/288 |
| 4,475,867 | 10/1984 | Smith | 415/119 |
| 4,508,486 | 4/1985 | Tinker | 415/119 |
| 4,573,636 | 3/1986 | Dilworth et al. | 239/2.2 |
| 4,692,091 | 9/1987 | Ritenour | 415/119 |

FOREIGN PATENT DOCUMENTS

| | | | |
|---|---|---|---|
| 0089590 | 9/1983 | European Pat. Off. | 239/14.2 |

*Primary Examiner*—Andres Kashnikow
*Assistant Examiner*—Karen B. Merritt
*Attorney, Agent, or Firm*—Herbert Dubno

[57] ABSTRACT

The apparatus for making artificial snow by atomizing water comprises a ductlike housing mounted on a supporting frame, in which a blower is positioned and on whose downstream end a plurality of nozzles or orifices for spraying water or a water-air-mixture are provided. The ductlike housing is constructed double walled. An inner wall of the ductlike housing is provided with a plurality of holes. Sound absorbing material in the interior space located between the inner wall and an outer wall and one electric heater are also provided. Air baffles can also be provided which contain sound absorbing material and are similarly heated.

9 Claims, 3 Drawing Sheets

SNOW-MAKING MACHINE

FIELD OF THE INVENTION

Our present invention relates to an apparatus for making artificial snow or a snow-making machine for use on ski slopes and like areas in which snow is desired.

BACKGROUND OF THE INVENTION

A snow-making machine for making artificial snow by atomizing water is known comprising a ductlike housing mounted on a supporting frame, in which a blower is positioned and at whose downstream end a plurality of nozzles or orifices for atomizing water or a water-air-mixture are located.

This snow-making machine produces artificial snow by displacing cold air at a temperature of 0° C. or less by the blower through the ductlike housing. Water and/or a water-air-mixture is atomized in the ductlike housing through nozzles or orifices located in the downstream end of the ductlike housing. Artificial snow is produced by the cooling effect upon the water droplets.

This known apparatus, however, is not satisfactory because it emits a very loud sound or noise from operation of the blower and the air flow through it. Considering that this noise is produced mainly at night since the cold air required for generation of artificial snow is more often available at night than in the daytime, it is necessary to make this apparatus as free of noise as possible. Otherwise the apparatus cannot be used in the vicinity of living quarters such as homes, hotels or the like.

An apparatus for making artificial snow in which pressurized water and pressurized air are mixed with each other and sprayed through nozzles is described in German Open Patent Application No. 29 41 052. This known apparatus does not have a ductlike housing inside of which a blower is located for generation of an air flow rushing past or grazing a plurality of orifices or nozzles. A double-wall construction is used here to damp or muffle the sound produced by the nozzles. The inner wall is perforated and a sound-absorbing material is located in the intervening space. Since moisture enters the sound-absorbing material, icing occurs so that the desired muffling of the sound is not guaranteed.

OBJECTS OF THE INVENTION

It is an object of our invention to provide an improved apparatus for making artificial snow which avoids prior-art drawbacks.

It is also an object of our invention to provide an improved snow-making machine which is reliable and quiet during operation under all operating conditions.

SUMMARY OF THE INVENTION

These objects and others which will become more readily apparent hereinafter are attained in accordance with our invention in an apparatus for making artificial snow by atomizing water with a ductlike housing mounted on a supporting frame, having a blower and at whose downstream end a plurality of nozzles for atomizing water or a water-air-mixture are provided.

According to our invention the ductlike housing is of double-wall construction.

An inner wall of the ductlike housing is provided with a plurality of holes and sound-absorbing material is provided in the interior spaced located between the inner wall and an outer wall. An electric heater is provided in this space.

The electric heater prevents icing of moisture forced into the sound muffling or sound lagging material.

Thus, the desired sound muffling effect would not be guaranteed without the heater. An effective sound muffling of the sound generated under all operating conditions is guaranteed in the apparatus according to our invention which as a result can be operated during the night hours even near living quarters without excessive noise inconveniences.

To further improve the sound absorption, advantageously a mat or layer made from sound damping material is positioned on the inner side of the outer wall of the ductlike housing.

The interior space between both of the walls of the ductlike housing can be divided into a plurality of regions in which a plurality of packets containing the sound-absorbing material are inserted.

An insert can be provided to protect the sound-absorbing material from additional damage on the inner side of the inner wall of the ductlike housing provided with holes.

The electric heater especially is located in the vicinity of the inner wall.

According to an additional advantageous feature of our invention at least one, advantageously approximately cylindrical and/or conical, air baffle can be located inside the ductlike housing axially ahead or behind the hub of the fan and/or axially ahead or behind a drive motor for the blower.

The casing of this air baffle can be perforated with holes and a sound-absorbing material can be located inside it. A sound-damping effect is thus provided with this baffle also.

Another electric heater can be provided in the casing of at least one of the air baffles to avoid the reduction of the sound damping effect as a result of icing.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
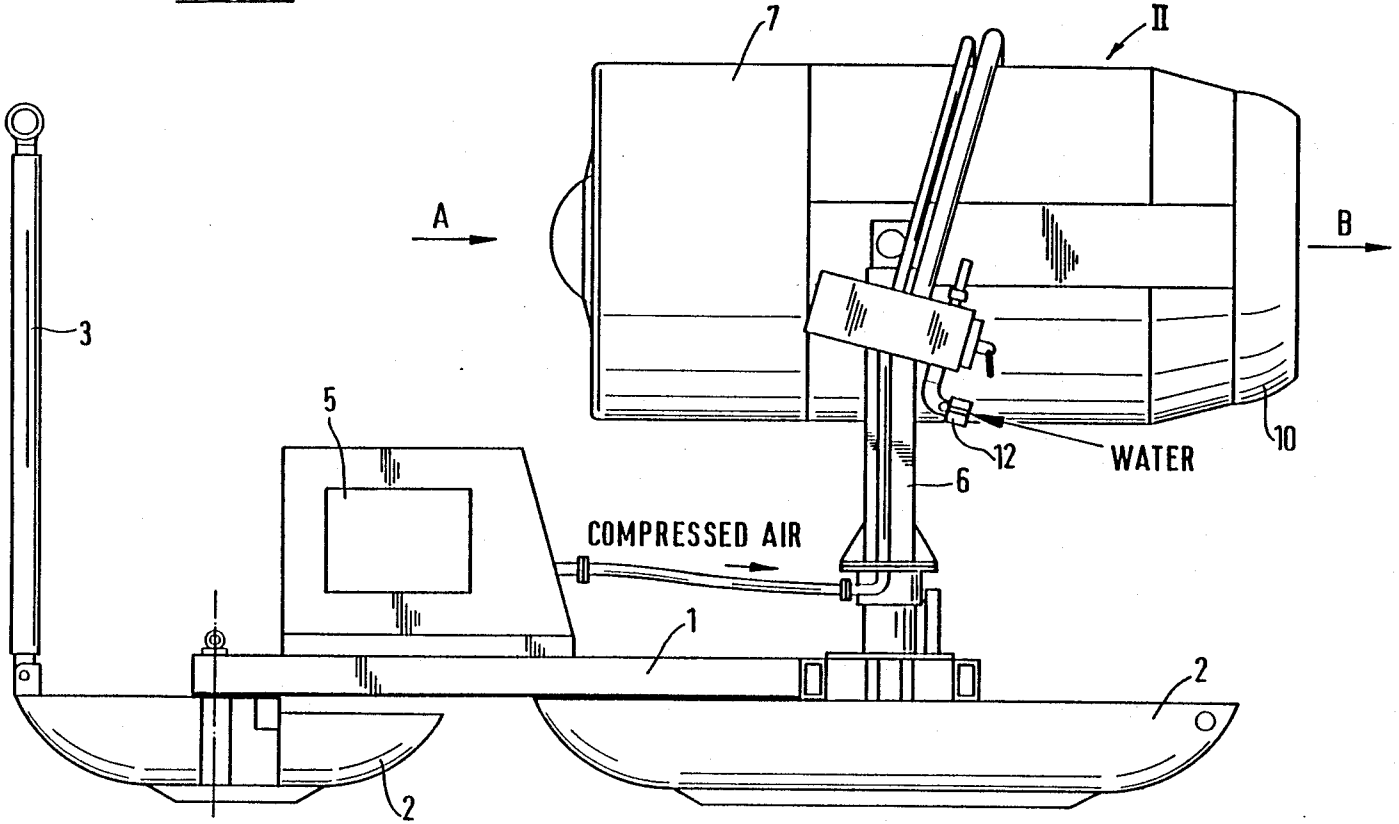
FIG. 1 is a side elevational view of an apparatus for making artificial snow according to our invention.

As is apparent from FIG. 1 the apparatus for making artificial snow comprises a supporting frame 1 which includes a skid or sled 2 and a towbar 3 so that this apparatus can be pulled by a snow tractor.

A compressor 5 for providing pressurized air and a mounting piece 6 for support of a ductlike housing 7 are supported by the supporting frame 1. The ductlike housing 7 produces a spray of artificial snow. The mounting piece 6 is movable horizontally relative to the supporting frame 1. The housing 7 is movable vertically relative to the mounting piece 6 and is pivotable about a horizontal axis.

The ductlike housing 7 is constructed with at least one ring 10 of orifices or nozzles on its right front end, as shown in the drawing, through which a water and/or a water-air-mixture can be sprayed. For feeding the apparatus with water a water connector 12 is provided on the ductlike housing 7 inside of which a water filter is located.

Inside the ductlike housing 7 is located a blower which is drivable by a motor positioned similarly inside the housing 7.

Cold surrounding air is pulled in by the blower 16 at a temperature below 0° C. in the direction of the arrow A and is fed through the ductlike housing 7. Water and/or a water-air mixture is sprayed by the nozzles 11 of the nozzle ring 10. Artificial snow which is delivered by the ductlike housing 7 in the direction of the arrow B is produced by the cooling experienced by the sprayed water droplets.

Figure 2:
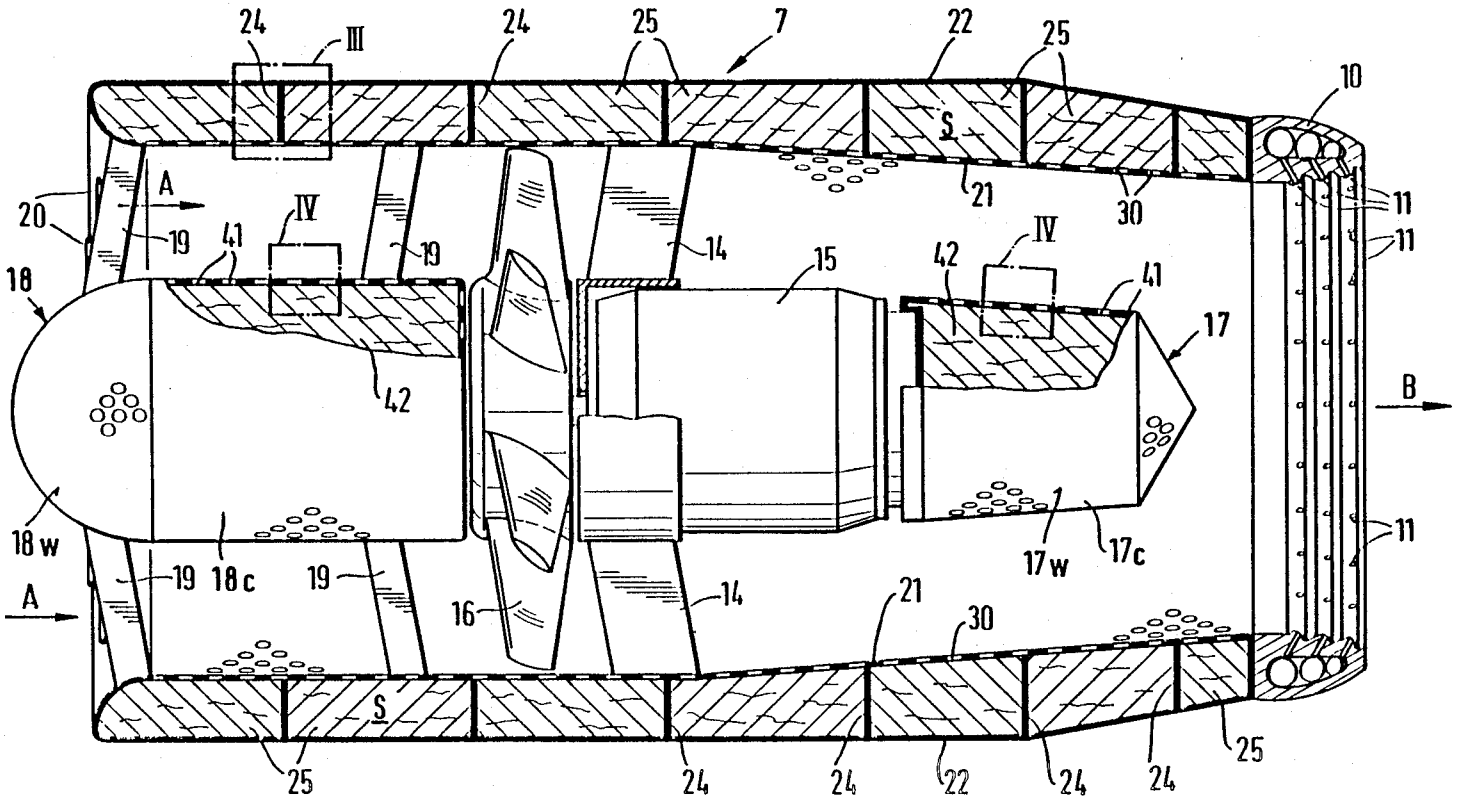
FIG. 2 is a partially broken away cross sectional view of the portion II of the apparatus shown in FIG. 1 drawn to a larger scale.

As is apparent from FIG. 2 the ductlike housing 7 has a double-wall construction. It has an inner housing wall 21 and an outer housing wall 22, e.g. of steel or aluminum.

A motor 15 which acts to drive the blower 16 is mounted by a plurality of cross pieces 14 in the interior of the ductlike housing 7.

A first air baffle 17 is located axially exterior to the motor 15 and another air baffle 18 is located axially outside the blower 16. At its left-hand end the housing 7 is covered by a screen 20.

As is also apparent from FIG. 2 the nozzle or orifice ring 10 comprises a plurality of orifices or nozzles 11.

The interior space S found between the inner wall 21 and the outer wall 22 is divided by radially extending cross members 24 into a plurality of regions in which packets 25 containing sound-absorbing material are inserted. These packets 25 are formed for example by glass fiber enclosed in a sound transmitting foil 26.

Figures 3, 4:
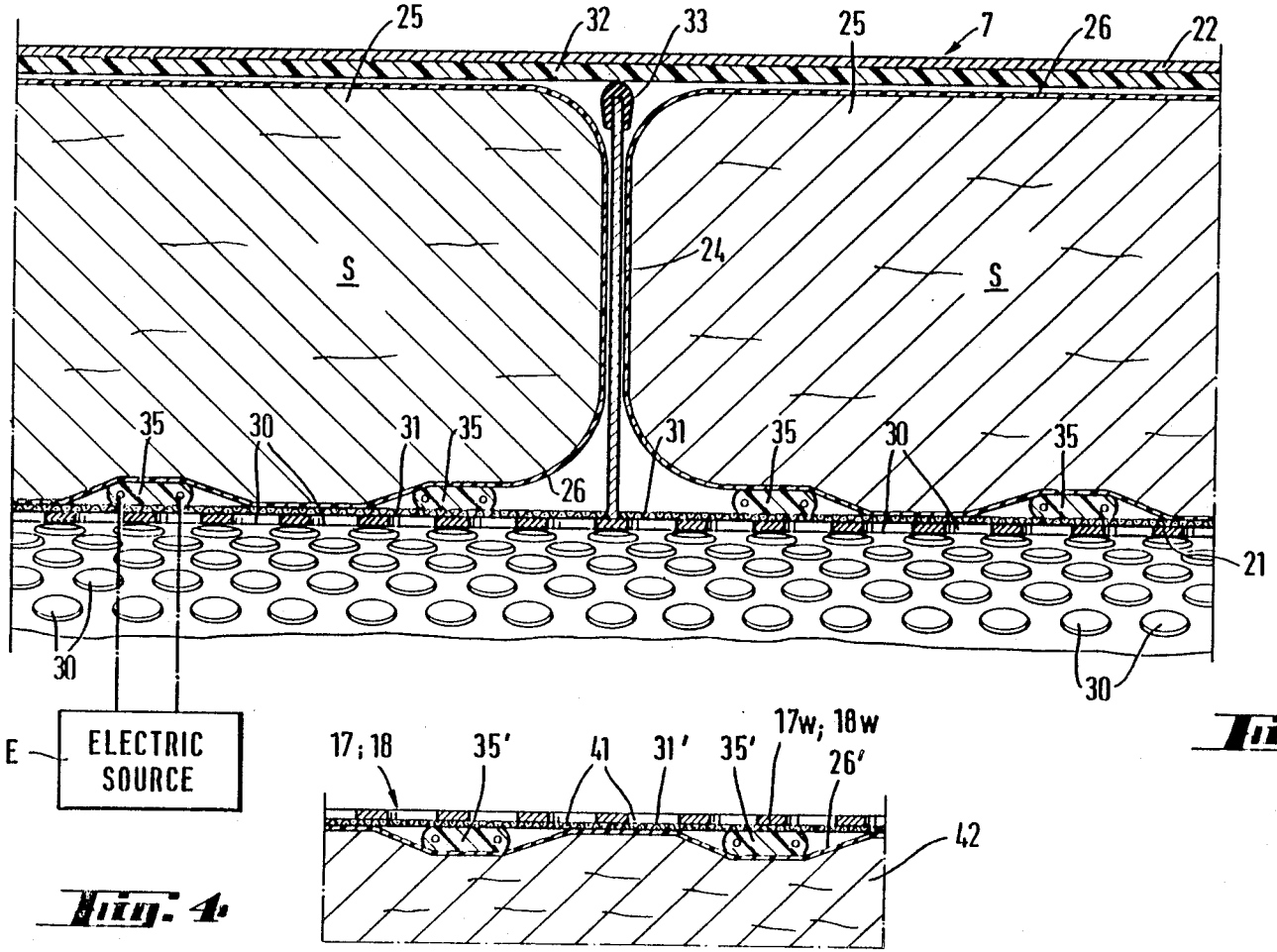
FIG. 3 is a cross sectional view of the portion III of the object shown in FIG. 2 drawn to still a larger scale.
FIG. 4 is the detailed cross section of the portion IV of the machine shown in FIG. 2.

In FIG. 3 the structure of the inner wall 21 and the outer wall 22 and/or the packets 25 are shown in detail. As is apparent the inner wall 21 is formed with a plurality of holes 30. A fabric insert 31 which acts to protect the packets 25 from damage is located on the inner side of this inner wall 21 having the holes 30. Further a mat or layer 32 is provided on the inside of the outer wall 22 which is made of sound-absorbing material. This mat or layer 32 passes by the cross members 24 and is not interrupted by them. Furthermore a seal 33 is positioned between the cross members 24 and the mat or layer 32.

Because of the structure of the inner wall 21 which has a plurality of holes 30, further because of the sound damping packets 25 inserted in the interior space S formed by both the inner wall 21 and the outer wall 22 and because of the sound-absorbing mat 32, the sound made by the air flowing through the ductlike housing 7 is strongly muffled or damped. Since this muffler action can be reduced by icing by which especially the holes 30 are partially closed, a plurality of electrical heating elements or a single heater 35, e.g. in the form of a heating tape, can be provided in the interior space S. The electrical heating elements 35 are mainly located on the wall 21 having the holes 30. An electric source E, such as a generator on the skid, is connected to the heater.

As is apparent from FIG. 4 the walls of both air baffles 17 and 18 are formed with holes 41 and the inner space defined by the walls is filled with sound-absorbing material 42. A sound muffling is also attained by the structure of the air baffles 17 and 18 which have holes and by the sound-absorbing material 42 located in them. Also the air baffles 17, 18 have an additional electric heater 35' having a plurality of electrical heating elements to prevent icing. Of course the walls **17*w*, 18*w* are part of the casing 17*c*, 18*c* of the air baffle 17, 18**.

Additionally the air baffles 17,18 are detachably mounted to make the motor 15 and the blower 16 accessible. Advantageously a locking device is provided by which it is guaranteed that the air baffles 17 and 18 are removable or foldable back only with the blower 16 stopped. The sound-absorbing material 42 is covered by a sound transmitting foil 26' and a fabric insert 31' protects the material 42.

We claim:

1. In an apparatus for making artificial snow by atomizing water comprising a ductlike housing mounted on a supporting frame, in which a blower is positioned and on whose downstream end a plurality of nozzles or orifices for atomizing water or a water-air-mixture are provided, the improvement wherein all of said ductlike housing has a double-wall construction, an inner wall of said ductlike housing being provided with a plurality of holes and sound-absorbing material in an interior space located between said inner wall and an outer wall, an electric heater being provided to prevent ice formation blocking said holes.

2. The improvement according to claim 1 wherein a mat made from said sound damping material is located on the inner side of said outer wall of said ductlike housing.

3. The improvement according to claim 2 wherein said interior space between both of said walls of said ductlike housing is divided into a plurality of regions in which a plurality of packets containing said sound-absorbing material are located.

4. The improvement according to claim 3 wherein on the inner side of said inner wall of said ductlike housing provided with said holes an insert for protection of said sound-absorbing material from damage is provided.

5. The improvement according to claim 1 wherein said one electric heater is located in the vicinity of said inner wall.

6. The improvement according to claim 1 wherein at least one air baffle with a casing is provided with a plurality of holes and which has said sound-absorbing material inside is positioned inside said ductlike housing axially exterior to said blower or axially exterior to said drive motor for said blower.

7. The improvement according to claim 6 wherein said air baffle has the shape of a body of revolution and another electric heater is provided in said casing of at least one of said air baffles.

8. An apparatus for making artificial snow by atomizing water comprising:

a double walled ductlike housing having an inner wall and an outer wall mounted on a supporting frame, said inner wall of said ductlike housing being provided with a plurality of holes and sound-absorbing material and an electric heater being provided in an interior spaced located between said inner wall and said outer wall;

a blower located totally within said double walled ductlike housing;

a plurality of nozzles or orifices for atomizing water or a water-air-mixture on the downstream end of said ductlike housing;

a mat made from said sound damping material positioned on the inner side of said outer wall of said ductlike housing and said interior space between both of said walls of said ductlike housing being divided into a plurality of regions in which a plurality of packets containing said sound-absorbing material are located; and an insert for protection of said sound-absorbing material from damage located adjacent the inner side of said inner wall of said ductlike housing, said electric heater being located in the vicinity of said inner wall.

9. An apparatus according to claim 8 further comprising at least one air baffle, whose casing is provided with a plurality of holes and which has said sound-absorbing material inside, positioned inside said ductlike housing axially exterior to said blower and/or axially exterior to said drive motor for said blower and each of said air baffles is approximately cylindrical and/or conical and another electric heater is provided in said casing of at least one of said air baffles.

* * * * *